US010041287B2

(12) United States Patent
Lessard et al.

(10) Patent No.: US 10,041,287 B2
(45) Date of Patent: Aug. 7, 2018

(54) SECONDARY RETENTION DEVICE FOR TRANSIT DOOR

(71) Applicant: Westinghouse Air Brake Technologies Corporation, Wilmerding, PA (US)

(72) Inventors: Marc Lessard, Laval (CA); Philippe Martel, St-Basile-le-Grand (CA)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 192 days.

(21) Appl. No.: 15/252,726

(22) Filed: Aug. 31, 2016

(65) Prior Publication Data

US 2018/0058131 A1 Mar. 1, 2018

(51) Int. Cl.

| | |
|---|---|
| ***E05F 15/652*** | (2015.01) |
| ***E05B 83/40*** | (2014.01) |
| ***E05B 83/36*** | (2014.01) |

(52) U.S. Cl.

CPC ..... *E05F 15/652* (2015.01); *E05B 83/363* (2013.01); *E05B 83/40* (2013.01); *E05Y 2900/51* (2013.01)

(58) Field of Classification Search

CPC .. E05F 15/652; E05F 15/655; E05Y 2201/22; E05Y 2201/434; E05Y 2201/64; E05Y 2900/51; B61D 19/02; E05B 83/363

See application file for complete search history.

(56) References Cited

U.S. PATENT DOCUMENTS

| | | | | |
|---|---|---|---|---|
| 4,198,786 | A | 4/1980 | Monot | |
| 5,341,598 | A * | 8/1994 | Reddy | B61D 19/02 49/362 |
| 6,009,668 | A * | 1/2000 | Reddy | E05C 3/34 49/280 |
| 6,032,416 | A | 3/2000 | Springer et al. | |
| 6,094,867 | A * | 8/2000 | Reddy | B61D 19/02 49/280 |
| 6,141,908 | A * | 11/2000 | Bowen | B60N 5/00 105/332 |
| 6,282,970 | B1 * | 9/2001 | Oakley | E05F 15/652 49/362 |
| 6,446,389 | B1 * | 9/2002 | Heffner | B61D 19/02 49/118 |
| 6,712,406 | B2 * | 3/2004 | Stojc | B60J 5/062 292/144 |
| 7,228,804 | B2 | 6/2007 | Stojc et al. | |
| 8,661,733 | B2 * | 3/2014 | Lee | E05B 47/0012 49/116 |
| 2002/0194783 | A1 * | 12/2002 | Stojc | F16H 25/24 49/118 |
| 2010/0319259 | A1 * | 12/2010 | Shi | E05F 15/622 49/280 |
| 2012/0011778 | A1 * | 1/2012 | Kong | E05B 81/00 49/503 |
| 2012/0073208 | A1 * | 3/2012 | Lee | E05F 15/652 49/449 |

* cited by examiner

*Primary Examiner* — Justin B Rephann
(74) *Attorney, Agent, or Firm* — The Webb Law Firm

(57) ABSTRACT

An overcenter locking mechanism for sliding transit doors with a secondary retention device.

4 Claims, 5 Drawing Sheets

SECONDARY RETENTION DEVICE FOR TRANSIT DOOR

BACKGROUND OF THE INVENTION

Field of the Invention

This invention pertains to transit vehicle doors, for example, passenger sliding transit side doors. Transit doors must be locked in the closed position. This invention relates to the addition of a secondary retention device to an overcenter locking mechanism.

Description of Related Art

Overcenter locking mechanisms are used in rail transit power door systems as a cost effective means of locking passenger doors upon their full closure. Various implementations of such overcenter locks have been designed and produced. Overcenter locks for rail transit vehicles are known in the art as described, for example, in Monot U.S. Pat. No. 4,198,786.

Bi-parting passenger transit side doors are known in the art as shown, for example, in Stojc et al. U.S. Pat. No. 7,228,804 and Springer et al. U.S. Pat. No. 6,032,416.

The American Public Transportation Association (APTA) Standard requires the use of a mechanical door lock preventing the door from opening until commanded to do so. The Standard has been updated recently to require prevention of the door from opening should the connection between the drive mechanism and the door supports fail.

Different types of locks are used for passenger doors. Among them, overcenter lock mechanisms are used as a cost effective way of locking the doors upon their full closure. These locks meet the initial requirements of the APTA Standard. However, due to their physical arrangement and working principle, they do not necessarily meet the requirements of preventing the doors from opening should the connection between the drive mechanism and the door panel become compromised.

SUMMARY OF THE INVENTION

Briefly, according to this invention, there is provided a system for opening and closing and locking in the closed position a sliding door panel over an opening in a transit vehicle wall. The system comprises a screw journaled parallel to the sliding directions of the door panel, a drive nut threaded on the screw integral with a cam follower assembly comprising a housing having a roller journaled thereon, motion transmission connecter extending between the drive nut and the door panel, a straight rolling track parallel to the sliding direction of the door panel arranged to receive the roller, thus preventing rotation of the drive nut, a curved rolling track aligned with the straight rolling track to receive the roller and guiding the roller in a curved path to rotate the drive nut and the cam follower assembly relative to the screw into a locked position, a reversible motor for driving the rotation of the screw to thus cause the movement of the drive nut along the screw and the door to slide in either the opening or closing direction, a striker affixed to the cam follower assembly positioned to rotate with the said cam follower in order to actuate a door locked sensing switch when the drive nut and the cam follower have rotated into the locked position, a blocker fixed relative to the door panel positioned to engage the cam follower housing preventing the opening of the door panel should the motion transmission connecter fail.

Preferably, a door closed sensing switch is provided for sensing when the door is fully closed and said blocker is positioned to permit sufficient opening of the door panel on failure of the motion transmission connecter for the door closed sensing switch to indicate the unlocked condition. Preferably, the door closed sensing switch striker is an extension of the blocker so that the relative position of the blocker and the striker is fixed.

BRIEF DESCRIPTION OF THE DRAWINGS

Further features and other objects and advantages will become apparent from the following detailed description made with reference to the drawings in which.

DESCRIPTION OF THE INVENTION

Figure 1:
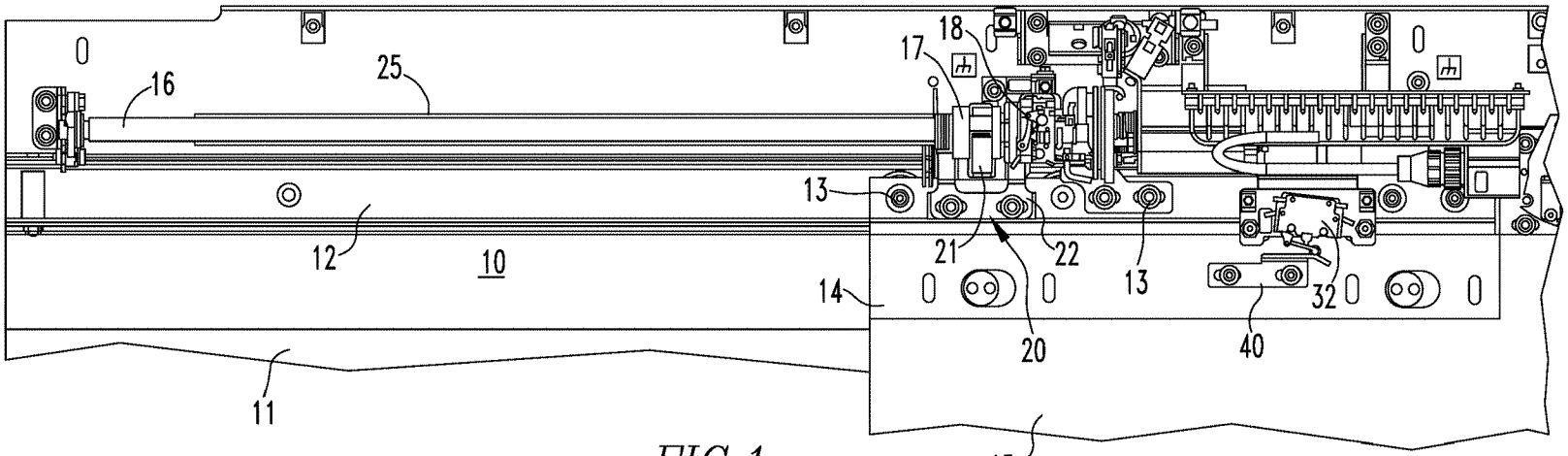
FIG. 1 is a front view of a system for opening and closing and locking a transit door according to one embodiment of this invention, in particular, a left hand door as seen from inside the vehicle.
Figure 2:
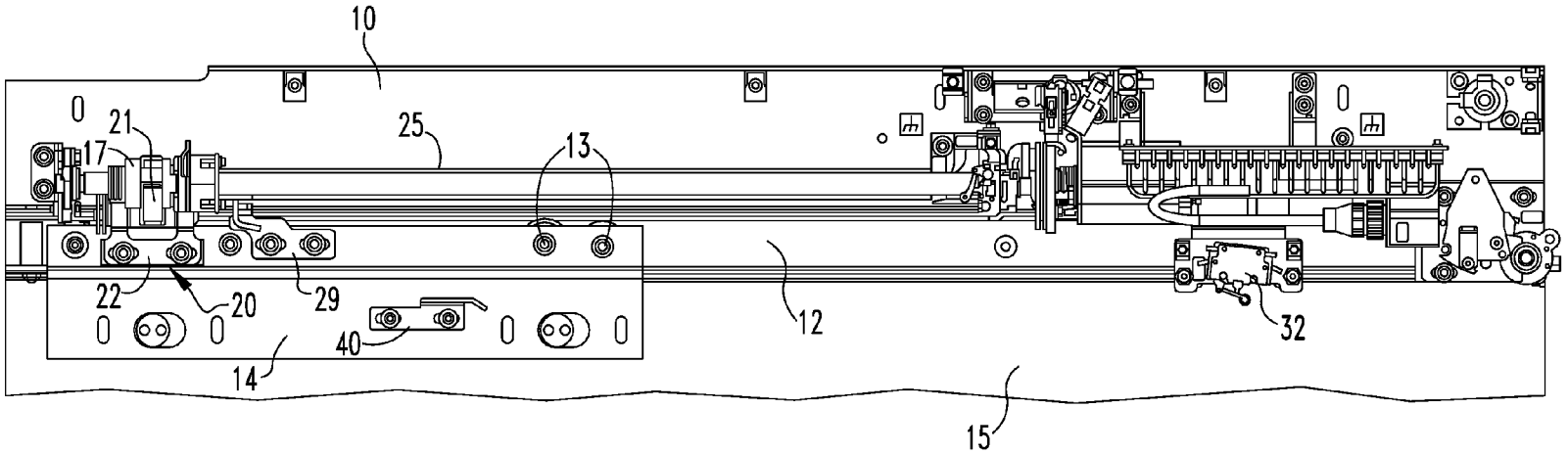
FIG. 2 is a front view of the system shown in FIG. 1 in the fully open position.

Referring now to FIG. 1, there is shown a base plate 10 for being secured to the wall 11 above the door opening in a transit vehicle. FIG. 1 illustrates a left opening door (left when viewed from outside the transit vehicle). It should be understood that this invention relates equally to right and left opening doors. The various parts of the right hand door opening and closing system are substantially mirror images of those for the left hand door opening system.

A channel 12 secured to or integral with the base plate 10 provides a track for a number of rollers 13 secured to a door hanging plate 14 which in turn is secured to a sliding door 15. The door is thereby hung for easy movement in two directions.

A drive screw 16 is journaled parallel to the sliding directions (defined by the channel 12) of the door panel. A drive nut 17 is threaded on the drive screw integral with a cam follower assembly 18 having a roller 19 (see FIGS. 4 and 5) journaled thereon.

A motion transmission connecter 20 extends between the drive nut 17 and the door hanging plate 14. In this embodiment, the drive nut 17 has a circumferential groove into which the fingers of a fork 21 rest. The fork is rotatably mounted at the other end to the door hanging plate by a hinge 22 with a removable axle 23 having an axis parallel to the sliding directions. The axle is secured by a retaining pin 24 (see FIG. 3).

A straight, rolling track 25 mounted to the base plate 10 parallel to the sliding direction of the door panel, is arranged to receive the roller 19 journaled on the cam follower assembly, thus preventing rotation of the drive nut 17. A curved rolling track 26 is aligned with the straight rolling track 25 at the door closed end to receive the roller.

Figure 6:
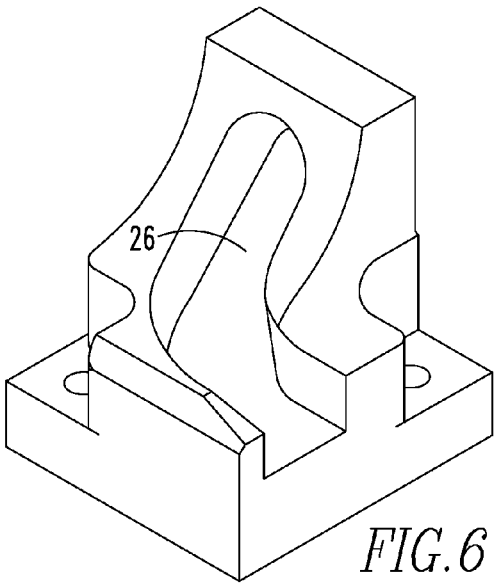
FIG. 6 is an isometric view of a curved rolling track for a right hand door.

Referring to FIG. 6, the curved rolling track 26 in this embodiment guides the roller 19 in a curved path to rotate the drive nut 17 and the cam follower assembly 18 relative to the drive screw 16 into an overcenter locked position. Preferably, the curved rolling track guides the roller in a curved path that moves in both a vertical and horizontal direction resulting in a rotation of the roller 19 by approximately 90 degrees. Thus, when the roller reaches the end of the curved rolling track, it is in an overcenter position resisting movement in the opening direction.

A reversible motor 27 is arranged for driving the rotation of the drive screw to thus cause the movement of the drive nut along the drive screw and also the door 15 to slide in either the opening or closing direction.

A striker 28 is affixed to the cam follower assembly positioned to rotate with the said cam follower in order to actuate a door locked sensing switch when the drive nut and the cam follower have rotated into the locked position as a result of the travel of the roller in the curved rolling track.

The motion transmission connecter 20 is made-up of a number of elements, namely the fork 21, the hinge 22, the axle 23, and bolt and nut fasteners 41, 42. The hazard to mitigate is defined as a failure of any one of these elements in such a way as to disconnect the door panel from the drive mechanism, thus rendering it free from moving in the open direction.

The mitigation to this hazard is a secondary retention device formed by a blocker 29 fixed relative to the door panel and positioned to engage the cam follower housing 30, preventing the opening of the door panel should any element of the motion transmission connecter 20 fail.

A transit door must have a manual door unlock mechanism for emergency opening of the door when for some reason the drive screw and nut cannot be operated by the motor. In the embodiment illustrated, a cable operated rotor 35 is rotatably positioned adjacent the cam follower assembly. When the cable is pulled, the rotation of the rotor 35 moves a cam (not shown) attached to the rotor to engage a cam follower surface 34 (see FIG. 5) to thereby rotate the cam follower assembly to lift the roller 19 out of the curved rolling track. Rotation of the cam follower assembly will also remove the cam follower assembly housing 30 from the path of the blocker 29.

Figure 5:
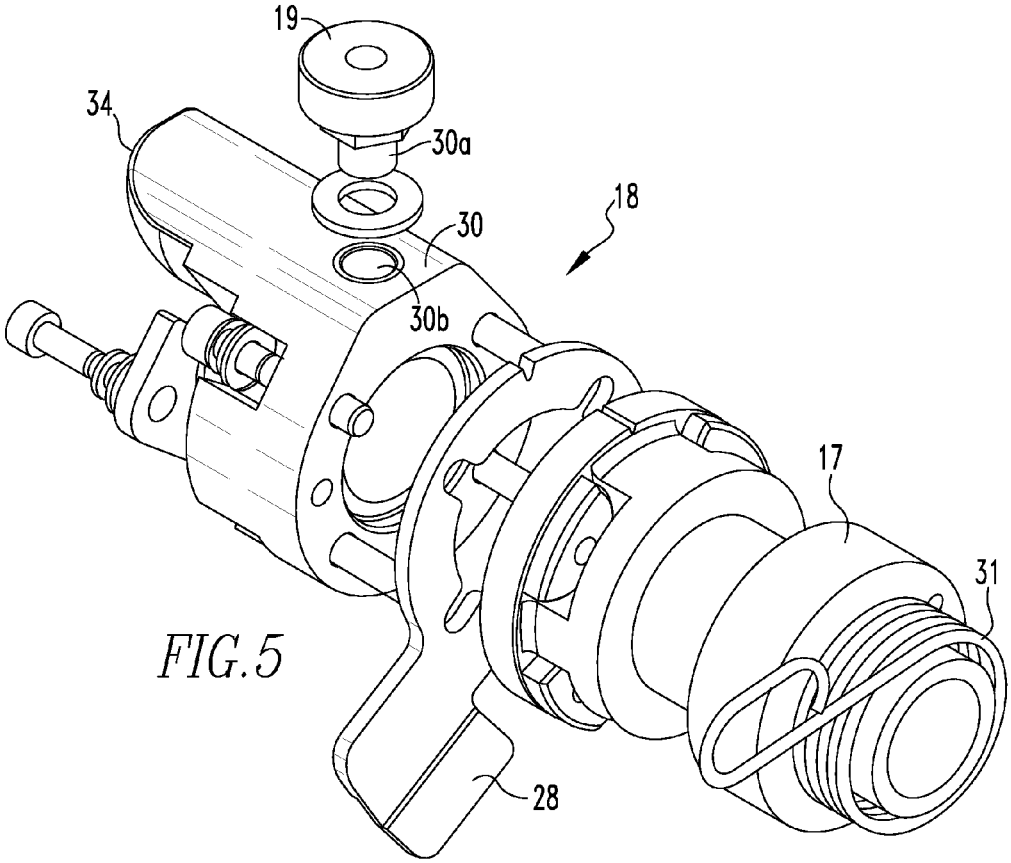
FIG. 5 is an exploded perspective view of the drive nut and the cam follower unit for a right hand door.

Referring to FIG. 5, the cam follower assembly 18 has a housing 30 with a bore 30*b* for receiving an axle 30*a* for the roller 19. The axle extends in a perpendicular direction to the axis of the drive nut and the cam follower assembly. Attached to the drive nut is a torsion spring 31. The spring forces the rotation of the roller 19 into the curved rolling track. If the spring fails and the roller does not fully reach the overcenter locked position, the lock sensing switch 33 will not be activated, thereby detecting a fault condition.

Figure 3:
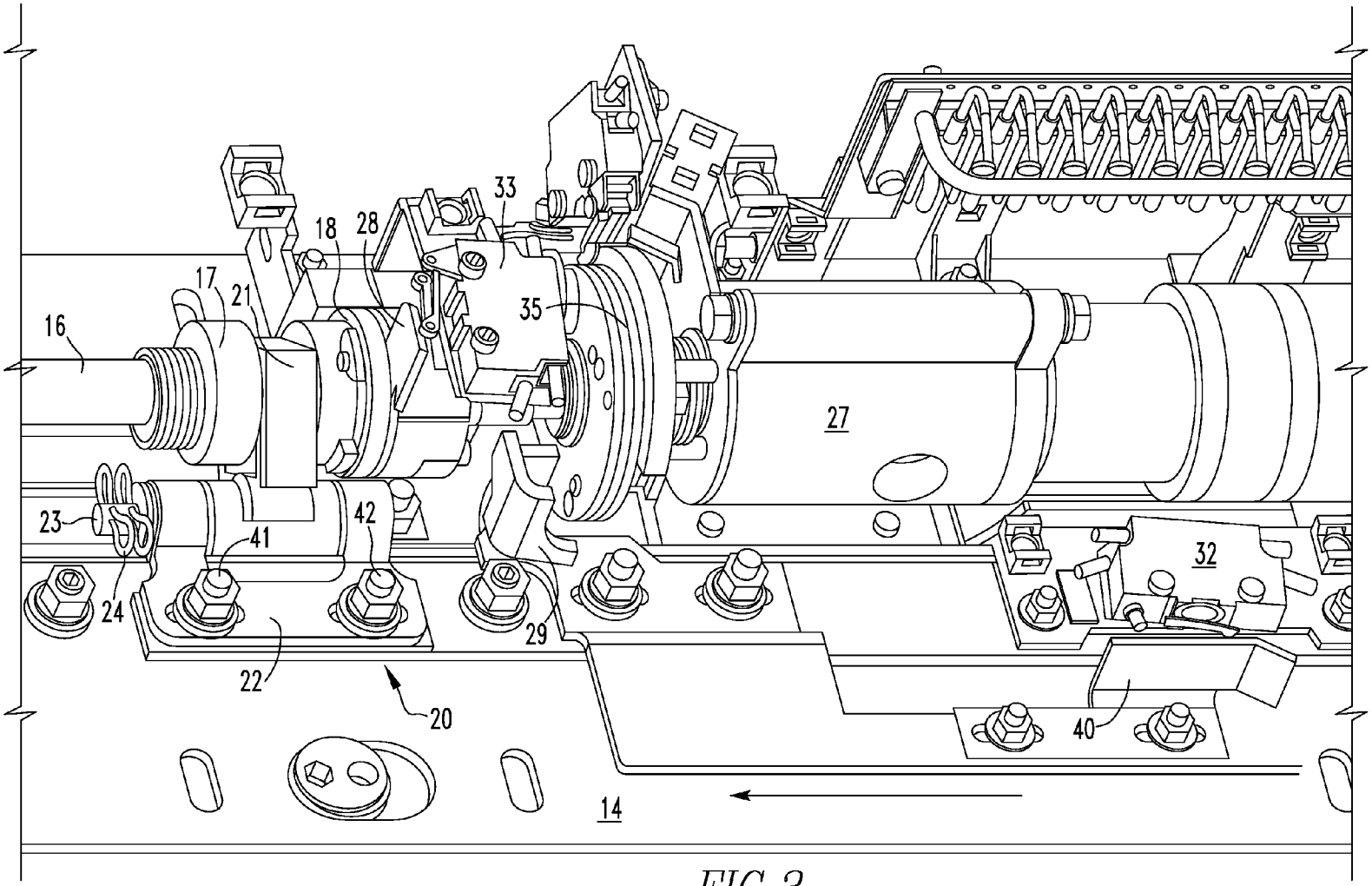
FIG. 3 is a perspective view of a portion of the system shown in FIG. 1.
Figure 4:
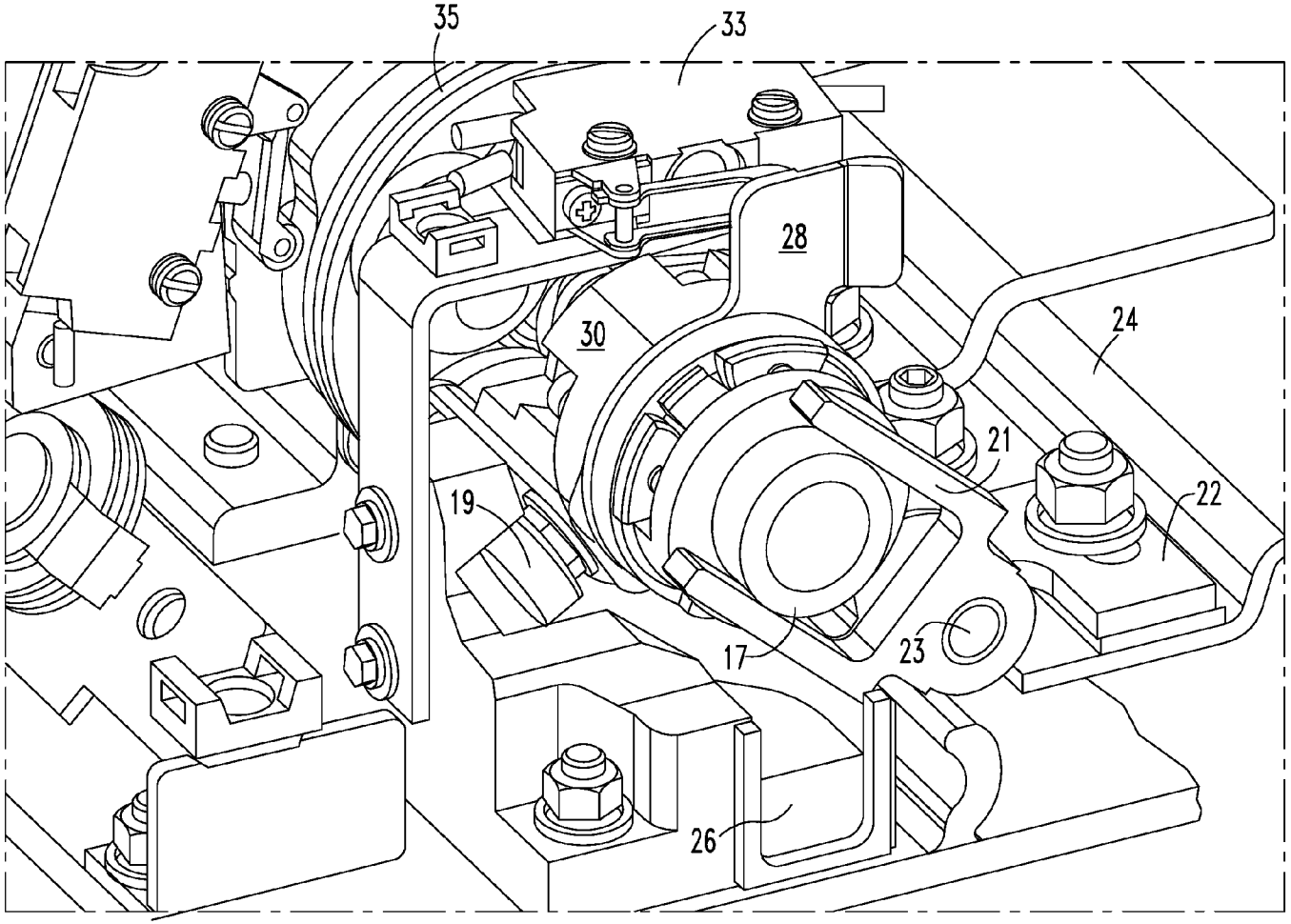
FIG. 4 is a perspective section view of the system shown in FIG. 1 in the closed and locked position.

FIG. 3 shows a section of a linear overhead door assembly for a sliding door. The motor 27 causes rotation of the drive screw 16. In turn, the rotation of the drive screw causes linear motion of the drive nut 17 to which is attached the cam follower assembly 18. This linear motion is transferred to the door panel by a motion transmission connecter 20. At the end of the door closing motion, the overcenter lock engages as best shown in FIG. 4. When engaged, the lock prevents any linear motion of the motion transmission connecter 20 which, therefore, locks the door panel in the closed position. Additionally, a lock sensing switch 33 mounted adjacent to the cam follower assembly senses when the roller has fully rotated into the overcenter locked position. Failure of the cam follower assembly 18, such that the roller 19 does not reach the overcenter locked position will, thus, be detected.

The motion transmission connecter 20, with its components as described above, is the only mechanical link between the door panel and the door lock. Should one component of this connecter be removed or its integrity be compromised, the door panel would be free to move but for the cam follower assembly 18 and the blocker 29. It is an advantage of this invention that, if the door 15 moves from the closed position towards the open position under a failure of the motion transmission connecter, the blocker 29 will hit the cam follower housing 30 preventing further movement of the door 15.

In order to maintain the safety integrity of the system, a failure of the motion transmission connecter 20 must be detected and annunciated so that remedial action can be taken. This is accomplished as follows. The blocker 29 is positioned so that the door is allowed to move a short distance, say one inch, before engaging the striker 40. This degree of opening is not a safety hazard. This movement will cause the door closed sensing switch 32 to change state indicating the door opening caused by failure of the motion transmission connecter.

It is a further advantage of this invention that it protects against failure of the drive nut if it is sheared at one end or the threads are stripped. Even so, if the roller 19 is in the overcenter locked position, the door would not be free to slide open.

Having thus described our invention in the detail and particularity required by the patent laws what is desired protected by Letters Patent is set forth in the following claims.

The invention claimed is:

1. A system for opening and closing and locking in the closed position a sliding door panel over an opening in a transit vehicle wall, the sliding door panel being movable in sliding directions between the open and closed positions, the system comprising:

- a screw rotatably mounted parallel to the sliding directions of the door panel;
- a drive nut threaded on the screw integral with a cam follower assembly comprising a housing having a roller rotatably mounted thereon;
- a motion transmission means extending between the drive nut and the door panel;
- a straight rolling track parallel to the sliding directions of the door panel arranged to receive the roller, thus preventing rotation of the drive nut;
- a reversible motor for driving rotation of the screw to cause movement of the drive nut along the screw and the door to slide in either of the sliding directions;
- a curved rolling track aligned with the straight rolling track to receive the roller and guiding the roller in a curved path to rotate the drive nut and the cam follower assembly relative to the screw into a locked position;
- a striker affixed to the cam follower assembly positioned to rotate with the cam follower in order to actuate a door locked sensing switch when the drive nut and the cam follower have rotated into the locked position; and
- a blocker fixed relative to the door panel positioned to engage the cam follower housing preventing opening of the door panel should the motion transmission means fail.

2. The system according to claim 1, wherein the curved rolling track carries the roller into an overcenter lock position.

3. The system according to claim 1, further comprising a door closed sensing switch indicating if the door is fully closed or not and said blocker positioned to permit sufficient opening of the door panel on failure of the motion transmission means for the door closed sensing switch to indicate a not fully closed condition.

4. The system according to claim 1, further comprising a switch sensing when the roller has moved through the curved rolling track to an overcenter locked position.

* * * * *